US005277130A

United States Patent [19]

Caporrella

[11] Patent Number: 5,277,130

[45] Date of Patent: Jan. 11, 1994

[54] MANICURE TABLE

[76] Inventor: Catherine Caporrella, Les Vignettes, 3962 Montana-Vermala, Switzerland

[21] Appl. No.: 781,238

[22] PCT Filed: May 10, 1991

[86] PCT No.: PCT/CH91/00110

§ 371 Date: Jan. 7, 1992

§ 102(e) Date: Jan. 7, 1992

[87] PCT Pub. No.: WO91/17682

PCT Pub. Date: Nov. 28, 1991

[30] Foreign Application Priority Data

May 12, 1990 [CH] Switzerland ..... 1788/90

[51] Int. Cl.[5] ..... A45D 29/00

[52] U.S. Cl. ..... 108/50; 108/64

[58] Field of Search ..... 108/50, 64, 161

[56] References Cited

U.S. PATENT DOCUMENTS 3,267,881 8/1966 Saggione .

3,366,415 1/1968 Cooper ..... 108/50

3,784,270 1/1974 DeLapp .

4,329,002 5/1982 Cowen et al. .

FOREIGN PATENT DOCUMENTS 0477917 5/1929 Fed. Rep. of Germany ..... 108/64

2300521 10/1976 France ..... 108/64

1160372 8/1969 United Kingdom .

*Primary Examiner*—Kenneth J. Dorner

*Assistant Examiner*—Gerald A. Anderson

*Attorney, Agent, or Firm*—Woodard, Emhardt, Naughton, Moriarty & McNett

[57] ABSTRACT

The manicure table is shaped in such a way that the client and the manicurist are not located opposite each other on one axis but rather at an angle to each other. The surface (1) of the table comprises an indent (2) where the client sits and at least one second indent (3) for the manicurist. This arrangement means the distance between the two persons is halved in comparison to a standard table, yet each person has ample leg room.

6 Claims, 2 Drawing Sheets

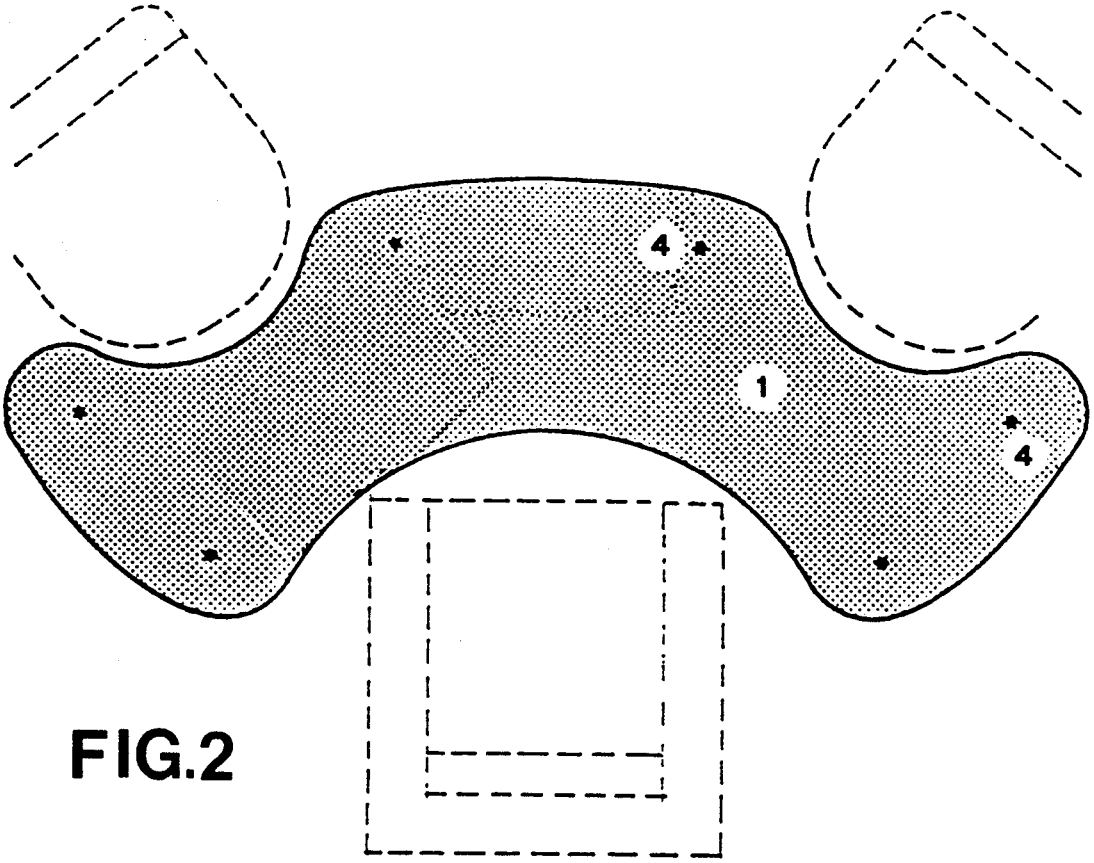
FIG.2
FIG.3
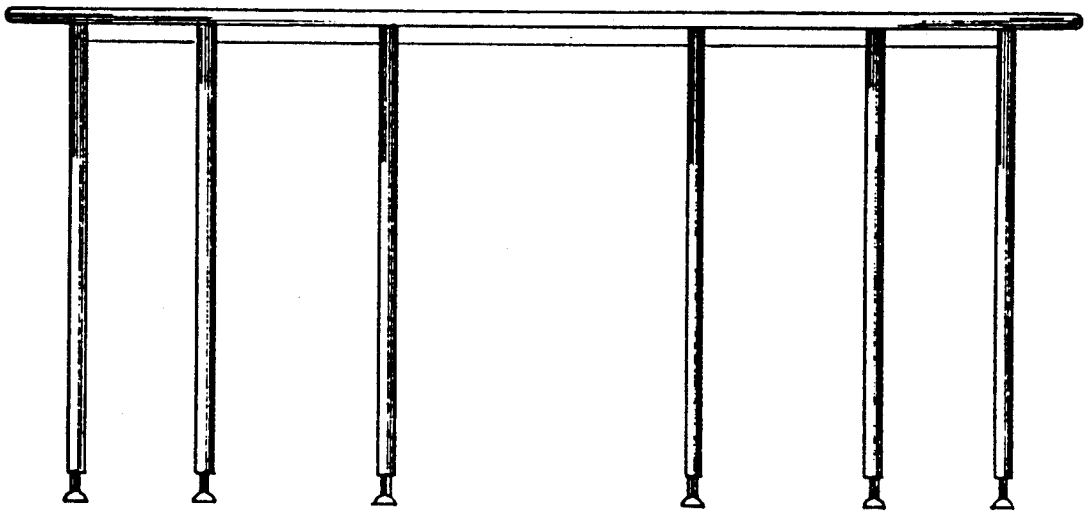

MANICURE TABLE

The present invention relates to a manicure table.

The care of hands and more particularly the care of nails have for a long time been regarded as activities or services subordinate to hairdressing itself.

When performing a manicure in conventional conditions, the manicurist was seated on a stool and the client simply had his/her hands placed on generally removable surfaces fixed to the armrests of his/her seat.

Hand and nail care have progressively assumed their own importance, and clients have started the habit of making appointments just for these services, i.e. without at the same time having a hair cut or a wash and set.

The managers of hairdressing salons have thus been induced to provide in their salon a section exclusively devoted to these services. The more and more marked dissociation between hairdressing and the care of hands and nails has logically resulted in the appearance of salons exclusively reserved for hand and nail care. Throughout this same evolution, the range of products and instruments used has also increased and no longer resembles the portable equipment which was previously known.

Regardless of whether the salon is completely devoted to manicure or whether there is a space reserved for manicure in a hairdressing salon, the furniture can be summed up as a rectangular work table. This table is most frequently in the form of a small table with two main parts, in which the equipment and the instruments are located. The width of the surface of the work table is normally 60 centimeters. The client and the manicurist are positioned on both sides of the table and have to place their legs in the space between the two main parts of the table. This exercise is even more difficult as the width of the table is, by necessity, relatively small, as has been said. Thus there is a contradiction in so far as the client and the manicurist would like to be farther apart so that they have more room for their legs, but the nature of the work implies the opposite.

As can be easily understood, the client's comfort must override the manicurist's comfort, and the manicurist will arrange her own legs depending on the position of the client's legs, regardless of whether it suits her or not.

To understand fully the many disadvantages which are found with the furniture used at present, it is necessary to describe the manner in which the manicurist works. In this short description, it is assumed that the manicurist is right-handed. She holds the client's hand in her left hand. The manicurist is sitting on the edge of her seat and is bending forward. Her left forearm rests on the table and gives her support. The right arm has to be free and unencumbered so as to be able to work and handle the instrument, mainly the file, in all the necessary orientations.

The normal working position thus has the following characteristics: bent back; great torsion of the top of the body towards the right; supported just by the left arm, i.e. eccentrically and not symmetrically; movement of the right arm without counter-support, causing tension in and locking of the top of the body in a most unhealthy position.

Clearly no one can maintain such a working position for eight hours a day over a long period of time without having serious problems with the vertebral column. The pain which results from maintaining this position quickly becomes intolerable and causes manicurists to restrict their activities, either voluntarily or on medical advice. Pure and simple withdrawal from the profession is more or less long term.

The object of the present invention is to propose a manicure table which enables all the above-mentioned drawbacks to be remedied.

The manicure table according to the invention is described in claim 1.

The following description is based on the drawings, in which:

FIG. 2 shows, in plan view, the manicure table according to the invention and indicates the positioning of the seats, as well as an example of the possible position of the legs of the table;

FIG. 3 shows the manicure table according to the invention, in front view, with the legs of the table being imagined in the same configuration as in preceding figure.

Figure 1:
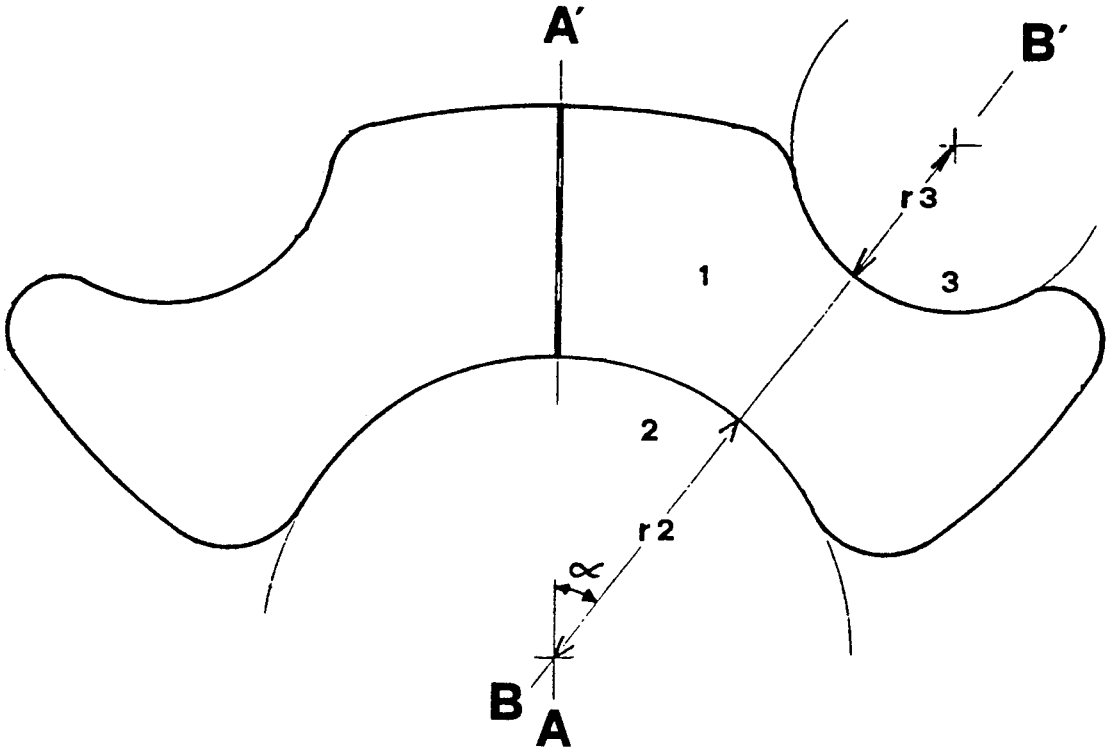
FIG. 1 illustrates the manicure table according to the invention, in plan view, and more particularly shows the shape of its surface.

In FIG. 1, the surface 1 of the table can be seen. This surface may be made of any material currently used in the furniture industry; preferably with a surface which is easy to clean. The surface 1 comprises a first indent 2, which is intended to receive the client. Here this indent, is made along an arc of a circle in which the radius r2 is roughly 50 centimeters. The client is installed in an easy chair so as to be in the axis AA'; the plane of her shoulders is thus perpendicular to the axis AA'. Measured along axis AA', the width of the surface 1 is roughly 40 centimeters. A second indent 3, which here is made along an arc of a circle in which the radius r3 is roughly 27 centimeters, is intended to receive the manicurist. The centre of the circle relative to the second indent 3 is placed on axis BB'; the manicurist sits on a chair so that the plane of her shoulders is perpendicular to axis BB'. The centre of the circle along which the indent 3 is made is 105 centimeters from the point of intersection of the axes AA' and BB'. Measured along axis BB', the width of the surface is roughly 30 centimeters.

From the moment when the axes AA' and BB' between them form an angle $\alpha$ of roughly 20° at least, the problem of the confrontation of the legs between the client and manicurist is resolved. However, it is with and angle $\alpha$ having a value of 35° to 40° that the arrangement appears to be optimal in use. In FIG. 1 the angle $\alpha$ shown has a value of 38°.

As will have already been noted, the above statements describe the right-hand part of the table. This arrangement would enable the manicurist to carry out her work on the right hand of the client. It could be imagined that the client pivots by 90° towards the right so as to present her left hand to the manicurist. However, she would thus be placed without a support for her other hand, in an empty space as it were, and this is the reason why it is specified that the table may be symmetrical with respect to axis AA'; all the statements given above for one of the sides obviously applies for the other side. The symmetrical shape of the table is also desirable for a simple matter of aesthetics.

The arrangement of the legs which support the table is a simple result of logic. One is completely free to chose the positioning and the number of the legs of the table, provided that they are not disposed precisely at the places where the client and the manicurist respectively place their legs. One example involving six feet 4 is given in FIG. 2, in which the client's armchair and the seats for the manicurist, or respectively for the manicurists, if there are two, can also be seen.

The legs of the table are designed so as to be adjustable in height, as can be seen in FIG. 3. The adjustment of the height is intended firstly to avoid the table being wobbly because of irregularities in the floor and secondly to enable the manicurist to adapt the height of the table according to her stature and preferences.

It is appropriate to stress the fact that the general shape of the table, as described above, has to be considered in its general outline. The dimensions given or the the detail of the shapes may be very freely modified, provided that the desired effect is present, i.e. the arrangement of the client and the manicurist along two separate axes. In this perspective, the existence of indents 3 intended for the manicurist is not indispensable. In fact a surface shaped like a rainbow can be created, with a width of roughly 30 centimeters. The interior of the arc then corresponds to the indent 2 and the manicurist may be placed at any point along the outer edge of the surface. However such a design would have at least two disadvantages. Firstly, even if the manicurist no longer has to support her weight on one of her arms, it remains useful for her to be able simply to rest her forearm up to the elbow, so as to avoid having to support it by an effort. The enveloping nature of the indents 3 rightly enables the creation of these support surfaces. Secondly, the storage of the instruments and products remains necessary. This is why a shape close to that illustrated in the figures is desirable, as it offers several possibilities for disposing small storage units beneath the table. Finally, devices for the direct lighting of the working area are used. The surfaces left by the imprint of the indents precisely enable the attachment of the lighting devices to the table without hindering the work. The shape illustrated in the figures in fact describes fixed work stations, which avoids having to resort to the repetitive adjustment of the location of the lighting, which would probably be the case with a table shaped as a rainbow.

To appreciate fully the influence of the shape given to the table according to the invention, it is advisable to recap on the respective positions of the client and the manicurist so as to compare them with those they had before.

The client is comfortably installed in an armchair and may perfectly rest against its back. Her legs may be stretched forward without encountering any obstacle. Although in theory at least one always aims for a comfortable position for the client, it may be noted that in the past the client nevertheless had to lean forward to offer her hand for treatment, which quite quickly caused her to rest on her other arm to find a support. With the table according to the invention, the client does not have to make any effort to offer her hand to the manicurist, she may quite simply rest her forearms on the table surface.

As was stated at the beginning of this description, it is the position of the manicurist which gave rise to the most numerous and most serious difficulties. The characteristics of the table according to the invention enable the manicurist to adopt a sitting position in which her back may be vertical. In fact, as her legs take up all the space necessary, the manicurist may draw closer to the table and no longer needs to bend forward. Thus she may advantageously use a work chair having a backrest supporting the vertebral column and remain permanently supported by this backrest, which was totally impossible before. She is also free to adapt the height of her seat as she intends. In fact, the choice of the height of the seat is no longer determined, even partially, by the necessity to lean forward to overlook her work, as the width of the table, at this point at least, is reduced by half when compared with conventional tables. As she is no longer leaning forward, the manicurist can take her client's hand without having to support herself on the appropriate forearm. The vertical position of the manicurist's back therefore results in her working arm being completely free to move, without any effort.

The manicurist may adjust the orientation of her seat so as to find exactly the position which suits here for the operation which she has to perform. Finally the client's hand is relatively close to the manicurist's body so that she only has to incline her head slightly to overlook her work perfectly.

The above explanations underline in detail the advantages of the table according to the invention. However the essential advantages can be summarised by stating that the table according to the invention offers the client a comfortable position while, at the same time, it offers the manicurist a perfectly healthy working position.

The symmetry of the table with respect to its central axis describes two work stations which the same manicurist can successively occupy to treat the right hand and then the left hand of her client, or vice versa. However, this feature also enables two manicurists to work simultaneously. It is doubtless a minor advantage when compared with all the advantages already mentioned. However it will be noted that, in this latter hypothesis, the length of the session is reduced by half.

I claim:

1. A manicure table of the type at which a manicurist and a client would be positioned on opposite sides thereof, comprising:

a table top surface having an outer peripheral edge and a centre axis that divides said top surface into first and second halves;

a first portion of said peripheral edge shaped in the form of a concave indention having a centre axis in common with the centre axis of said top surface;

a second portion of said peripheral edge located in said first half of said top surface shaped in the form of a second concave indention having a second centre axis located on a line that intersects and extension of the centre axis of said top surface at an angle of about 20 to about 60 degrees;

a third portion of said peripheral edge located in said second half of said top surface shaped in the form of a third concave indention having a third centre axis located on a line that intersects an extension of the centre axis of said top surface at an angle of about 340 to about 300 degrees; and means to support said table top surface at a predetermined distance above a floor.

2. The manicure table of claim 1 wherein said second centre axis is located on a line that intersects an extension of said centre axis of said top surface at an angle of about 40 to about 45 degrees.

3. The manicure table of claim 2 wherein said third centre axis is located on a line that intersects an extension of said centre axis of said top surface at an angle of about 320 to about 325 degrees.

4. A manicure table of the type at which a manicurist and a client would be positioned on opposite sides thereof, comprising:

a table top surface having an outer peripheral edge and a centre axis that divides said top surface into first and second halves;

a first portion of said peripheral edge shaped in the form of a concave arc of a first circle having its centre point located on an extension of the centre axis of said top surface;

a second portion of said peripheral edge located in said first half of said top surface shaped in the form of a concave arc of a second circle having its centre point located on an extension of a radius of said first circle that lies about 20 to about 60 degrees from said centre axis;

a third portion of said peripheral edge located in said second half of said top surface shaped in the form of a concave arc of a third circle having its centre point located on an extension of a radius of said first circle that lies about 340 to about 300 degrees from said centre axis; and means to support said table top surface at a predetermined distance above a floor.

5. The manicure table of claim 4 wherein said centre point of said second circle is located on an extension of a radius of said first circle that lies about 40 to about 45 degrees from said centre axis.

6. The manicure table of claim 5 wherein said centre point of said third circle is located on an extension of a radius of said first circle that lies about 325 to about 320 degrees from said centre axis.

* * * * *

UNITED STATES PATENT AND TRADEMARK OFFICE

CERTIFICATE OF CORRECTION

PATENT NO. : 5,277,130

DATED : January 11, 1994

INVENTOR(S) : Catherine Caporrella

It is certified that error appears in the above-identified patent and that said Letters Patent is hereby corrected as shown below:

In column 4, line 46, change "and" to -- an --.

Signed and Sealed this

Third Day of May, 1994

Bruce Lehman

*Attest:*

BRUCE LEHMAN

*Attesting Officer*

*Commissioner of Patents and Trademarks*